US006930539B2

(12) United States Patent
Erckert

(10) Patent No.: US 6,930,539 B2
(45) Date of Patent: Aug. 16, 2005

(54) REFERENCE VOLTAGE CIRCUIT AND METHOD OF GENERATING A REFERENCE VOLTAGE

(75) Inventor: Ricardo Erckert, Bad Aibling (DE)

(73) Assignee: Infineon Technologies AG, Munich (DE)

( * ) Notice: Subject to any disclaimer, the term of this patent is extended or adjusted under 35 U.S.C. 154(b) by 34 days.

(21) Appl. No.: 10/447,650

(22) Filed: May 29, 2003

(65) Prior Publication Data

US 2003/0234680 A1 Dec. 25, 2003

(30) Foreign Application Priority Data

May 29, 2002 (DE) ..... 102 23 996

(51) Int. Cl.[7] ..... G05F 1/46; G05F 1/575
(52) U.S. Cl. ..... 327/540; 327/544; 323/313
(58) Field of Search ..... 327/538–541, 327/543, 544; 323/313

(56) References Cited

U.S. PATENT DOCUMENTS 4,075,623 A 2/1978 Futagawa et al. ..... 327/535
5,243,271 A * 9/1993 Lommers ..... 323/279
5,703,528 A * 12/1997 Nebuloni et al. ..... 330/51
5,796,294 A * 8/1998 Perry ..... 327/538
6,737,844 B2 * 5/2004 Trivedi et al. ..... 323/283

* cited by examiner

*Primary Examiner*—Timothy P. Callahan
*Assistant Examiner*—Terry L. Englund
(74) *Attorney, Agent, or Firm*—Laurence A. Greenberg; Werner H. Stemer; Ralph E. Locher

(57) ABSTRACT

A reference voltage circuit has a reference voltage source, a charge storage device and also switching devices, which enable occasional operation of the reference voltage source during an on-time period. A reference voltage generated by the reference voltage source during the on-time period is stored in analog form with the charge storage device for the duration of an off-time period. The reference voltage source draws an operating current only during the on-time period. The result is a reduction of the power consumption. During the generation of the reference voltage, the operating current of the reference voltage source is not reduced compared with conventional reference voltage circuits.

23 Claims, 6 Drawing Sheets

REFERENCE VOLTAGE CIRCUIT AND METHOD OF GENERATING A REFERENCE VOLTAGE

BACKGROUND OF THE INVENTION

Field of the Invention

The invention relates to a method for the generation of a reference voltage and to a reference voltage circuit. The reference voltage circuit has a reference voltage source, an input terminal for feeding in an operating current, at least one reference terminal and a reference voltage terminal. The input terminal is connected via a first signal path, and the reference voltage terminal is connected via a second signal path to the reference voltage source.

With the aid of an auxiliary or supply voltage, reference voltage circuits generate a precise reference voltage that is independent of the amplitude of the auxiliary or supply voltage. Such an independent reference voltage is essential for the operation of a multiplicity of electronic systems. Any electronic system which detects or generates analog signals requires a reference voltage for the scaling of the analog signals. Widespread applications may be found in measurement electronics, in automotive engineering and in mobile telephones.

Reference voltage circuits are embodied with great diversity in the simplest case as passive voltage dividers or as Zener diode references. In this case, each reference voltage circuit requires an operating current which must be large enough in order to ensure operational reliability and interference immunity. Furthermore, the reference voltage circuit demands that the reference voltage be largely independent of the temperature of the components forming the reference voltage circuit.

One customary type of a precise reference voltage circuit with internal temperature compensation which, moreover, can be operated reliably even at low operating currents is the bandgap reference. Bandgap references are in turn widespread in a multiplicity of variants (Widlar bandgap reference, Brokaw bandgap reference, etc.), but are always based on an identical principle.

In this case, the reference voltage is derived from the base-emitter voltage $U_{BE}$ of a transistor, which voltage can be attributed to a basic physical quantity, indeed the bandgap voltage of the transistor material, and otherwise depends only on the temperature of the transistor. The temperature coefficient of the base-emitter voltage is largely-linear and negative. By means of a second transistor, which is the same as the first transistor but is operated at a different emitter current density, a differential voltage with a temperature coefficient which has an identical magnitude but is positive is formed across a resistor in series with the base-emitter junction of the first transistor.

Such bandgap references may be constructed in discrete fashion, are offered as monolithically integrated modules or are integrated, in turn, in complex semiconductor circuits such as analog/digital converters, switching regulators or ASICs (application-specific integrated circuits).

Furthermore, bandgap references are known wherein an integrated operational amplifier is operated with alternately switched input signals ("chopped"). In this case, the differential input signal of the operational amplifier is switched with alternating polarity to the inputs of the operational amplifier. In this case, the switching frequency is chosen to be high enough to average out an offset at the output of the operational amplifier on account of the inertia of the operational amplifier.

The range of applications of reference voltage circuits is increasingly expanding to at least occasionally battery-backed systems (remote sensing, mobile telephones, automotive). Since the power consumption of such electronic systems is generally lowered by a wide variety of measures, the proportion of the total power consumption of such a battery-backed system which is made up by the power consumption of reference voltage circuits is gaining in importance. This has a value up to several hundred $\mu$W for conventional bandgap references.

In this case, the bandgap references are operated with the smallest possible operating current at which the reference voltage is not yet corrupted to an impermissibly great extent by leakage currents. In this case, leakage currents are predominantly currents between circuit sections and a semiconductor substrate of a semiconductor device wherein the bandgap reference is embodied. Reliable operation of a bandgap reference necessitates an operating current which is greater, by at least a factor of 100, than the sum of the leakage currents. For customary technologies, operating temperatures and tolerance conditions, the operating current is between 5 and 100 $\mu$A. In customary electronic systems and subsystems in battery-backed applications, the operating current of a bandgap reference often makes up a not inconsiderable proportion of the total current consumption.

A further reduction of the operating current requires higher resistances. Higher resistances disadvantageously increase the noise of a reference voltage signal thus generated. When the reference voltage circuit is realized in a semiconductor substrate, moreover, higher resistances require a larger area in the semiconductor substrate. The leakage current of the configuration rises, in turn, as the area increases.

SUMMARY OF THE INVENTION

It is accordingly an object of the invention to provide a reference voltage circuit and a method of generating a reference voltage which overcome the above-mentioned disadvantages of the heretofore-known devices and methods of this general type and which provide for a reference voltage circuit that has a low power consumption, and also a method for the generation of a reference voltage with a low power consumption.

With the foregoing and other objects in view there is provided, in accordance with the invention, a method of generating a reference voltage with a reference voltage circuit, the method which comprises:

charging a charge storage device at least occasionally during an on-time period of uninterrupted voltage supply of a reference voltage source;

wherein the voltage supply of the reference voltage source is occasionally interrupted for an off-time period; and generating the reference voltage from the charge storage device at least during the off-time period.

With the above and other objects in view there is also provided, in accordance with the invention, a reference voltage circuit, comprising:

a reference voltage source, an input terminal for feeding in an operating current, a first signal path connecting the input terminal to the reference voltage source; at least one reference terminal, a reference voltage terminal, and a second signal path connecting the reference voltage terminal to the reference voltage source;

a first switching device connected in the first signal path, and a second switching device connected in the second signal path; and a charge storage device having a first terminal connected to the reference voltage terminal for a voltage supply thereof.

The switching devices can be set to two different configurations, whereby:

in a first configuration of the first and second switching devices, the charge storage device is connected for temporarily charging with the operating current from the input terminal via the reference voltage source; and in a second configuration of the first and second switching devices, the reference voltage source and the charge storage device are isolated from the input terminal.

In other words, the reference voltage circuit of the generic type has a reference voltage source, an input terminal for feeding in an operating current, at least one reference terminal and a reference voltage terminal, the input terminal being connected via a first signal path, and the reference voltage terminal being connected via a second signal path to the reference voltage source.

The reference voltage circuit according to the invention is characterized in that a first switching device is provided in the first signal path, in that a second switching device is provided in the second signal path, in that a charge storage device is provided, a first terminal of which is connected to the reference voltage terminal for the voltage supply thereof, in that, in a first configuration of the switching devices, the charge storage device can be temporarily charged by means of the operating current from the input terminal via the reference voltage source, and in that, in a second configuration of the switching devices, the reference voltage source and the charge device can be isolated from the input terminal.

The reference voltage circuit according to the invention thus has, besides a reference voltage source, a charge storage device and also switching devices which enable an occasional operation of the reference voltage source during an on-time period. A reference voltage generated by the reference voltage source during the on-time period is stored in analog form by means of the charge storage device for the duration of an off-time period. The reference voltage source draws an operating current only during the on-time period, so that the power consumption of the circuit is reduced by a factor which approximately corresponds to the ratio of the on-time period to the sum of on-time period and off-time period. What is essential to the invention in this case is that the operating current of the reference voltage source is indeed not reduced compared with conventional reference voltage circuits during the generation of the reference voltage and the reference voltage is therefore generated with essentially the same accuracy and reliability as is customary in the case of conventional reference voltage circuits.

In accordance with the reference voltage circuit according to the invention, a reference voltage source is connected via a first signal path to an input terminal of the reference voltage circuit, via which an operating current is fed to the reference voltage source during an on-time period from an auxiliary or supply potential. A reference output of the reference voltage source is furthermore connected via a second signal path to a reference voltage terminal of the reference voltage circuit, at which the reference voltage can be tapped off. Moreover, the reference voltage source is connected via at least one reference signal path to one or more reference terminals, via which the operating current is fed back to the auxiliary or supply voltage source and to whose potential the reference voltage at the reference voltage terminal is referred.

A controllable first switching device is arranged in the first signal path. During an on-time period, the first switching device is closed and the reference voltage source generates a defined reference voltage at the reference output. A controllable second switching device is arranged in the second signal path between the reference output of the reference voltage source and the reference voltage terminal of the reference voltage circuit. The second switching device is closed during a charging time period. A charge storage device connected by a first terminal to the reference voltage terminal and the second switching device is charged up to the reference voltage. If the second switching device is opened, then the charge storage device holds the stored charge and thus also a potential at the reference voltage terminal at the value of the reference voltage. The reference voltage source is then isolated from the auxiliary or supply potential through the opening of the first switching device.

The voltage of the charge storage device is gradually reduced by load and/or leakage currents, so that the charging operation has to be repeated from time to time.

In this case, a second terminal of the charge storage device is preferably connected with low impedance to a reference terminal. A switchable or an indirect connection of the charge storage device to the reference terminal is also possible in accordance with the application.

In this case, the reference voltage source provided may be, for instance, a passive voltage divider, a Zener diode reference or a discrete bandgap reference.

The reference voltage circuit according to the invention is particularly advantageous when a monolithically integrated bandgap reference is provided as the reference voltage source. It holds true precisely in the case of monolithically integrated bandgap references that the size of a technology-dictated leakage current prescribes the required operating current of the reference voltage source, in other words a defined limit is imposed on a minimization of the operating current and thus the power consumption for reasons of the accuracy of the reference voltage generated.

The driving of the controllable first and second switching devices is possible, for instance in the case of semiconductor devices (ICs) with monolithically integrated reference voltage sources, by the feeding of external signals. In this case, the external signals are fed to the semiconductor devices via additional terminals or are derived from other circuit sections of the semiconductor device.

Preferably, the reference voltage circuit according to the invention has a pulse generator circuit for generating periodic signals. The pulse generator circuit is connected to a control input of the first switching device by means of a third signal path and generates a periodic ENABLE signal on the third signal path. Furthermore, the pulse generator circuit is connected to a control input of the second switching device by means of a fourth signal path and generates a periodic SAMPLE signal on the fourth signal path.

Through the assignment of the pulse generator circuit to the reference voltage circuit, it is possible to optimize the period and signal duration of the ENABLE signal and of the SAMPLE signal for the respective reference voltage source and application. The use of such reference voltage circuits is particularly simple for the user.

A pulse generator circuit can be realized particularly rapidly and simply and with a very low space and power requirement in an integrated semiconductor device.

According to a further preferred embodiment of the reference voltage circuit according to the invention, the first and second switching devices are driven via a voltage monitoring circuit which monitors the voltage at the reference voltage terminal and is connected to the control inputs of the first and second switching devices via further signal paths. With such a voltage monitoring circuit, the accuracy of the reference voltage and the power consumption of the reference voltage circuit can be optimized with respect to one another by minimizing the on-time period. In this case, the first switching device is closed only when the voltage monitoring circuit detects a deviation of the reference voltage which is greater than a permissible deviation.

Preferably, the voltage monitoring circuit has a control signal path with a control switching device and a control storage device. The control storage device is occasionally connected to the reference output of the reference voltage source via the control switching device, which is operated essentially synchronously with the second switching device, and is charged together with the charge storage device to the potential of the reference voltage. The control storage device and the charge storage device differ significantly in their capacitances. Since the level of the leakage currents of the control storage device and of the charge storage device is essentially determined by the respectively assigned switching device and is independent of the capacitance value to a first approximation, the voltages across the two storage devices change at different speeds. The voltage change at the charge storage device, that is to say at the reference voltage terminal, can therefore be deduced from the difference between the two voltages.

In the case of a discrete construction of the reference voltage circuit, for instance, the second switching device is a relay or a transistor switch. When the reference voltage circuit according to the invention is realized in a monolithically integrated semiconductor device, the second switching device can be realized as a MOSFET (metal oxide semiconductor field effect transistor). A resulting leakage current which alters the voltage at the charge storage device is then essentially determined by the leakage current of the MOSFET in the non-conducting, open state. In this case, the design of the MOSFET as an N-MOSFET or P-MOSFET determines the direction of the leakage current and the sign of a resultant voltage change at the reference voltage terminal. A leakage current induced by a second switching device embodied as a P-MOSFET leads to a rise in the reference voltage at the reference voltage terminal. If the second switching device is embodied as an N-MOSFET, then the leakage current induced thereby leads to a decrease in the reference voltage.

According to a particularly preferred embodiment of the reference voltage circuit according to the invention, the second switching device is embodied as a parallel circuit comprising an N-MOSFET and a P-MOSFET. In this case, the leakage currents induced by the two MOSFETs compensate for one another to a considerable extent. Since the reference voltage in total changes significantly more slowly, a longer Off-time period is permissible. A longer Off-time period advantageously leads to a further reduced power consumption.

Monolithically constructed bandgap references quite generally have a feedback path and a low-pass filter capacitance in the feedback path. An oscillation of the feedback system is prevented in a customary manner by means of the low-pass filter capacitance. When the bandgap reference is switched on, the low-pass filter capacitance is first at least partially charged before the reference voltage is present in stable fashion at the output of the bandgap reference. After the bandgap reference is switched off, the low-pass filter capacitance is at least partially discharged, so that it has to be charged anew in the event of the bandgap reference subsequently being connected to the auxiliary and supply voltage.

According to a further preferred embodiment of the reference voltage circuit according to the invention, a further switching device is in each case arranged in the two leads of the low-pass filter capacitance. Control inputs of the further switching devices are connected via further signal paths to the pulse generator circuit or the voltage monitoring circuit, and are opened and closed essentially synchronously with the first switching device, that is to say with the ENABLE signal. As a result, the charge on the low-pass filter capacitance is frozen during the off-time period. When the bandgap reference is switched on again, the low-pass filter capacitance is already charged. The time duration after which the reference voltage signal is present in stable fashion at the output of the bandgap reference after renewed closing of the first switching device is reduced. The charge storage device can be switched to the bandgap reference earlier by means of the second switching device without any loss of accuracy and the on-time period can therefore be shortened. This is advantageously accompanied by a further reduction of the power consumption.

The level of the leakage currents in a semiconductor device is highly dependent on the temperature of the semiconductor device. An increase in the temperature of the semiconductor device by about 6 K leads approximately to a doubling of the leakage current density. The operating currents are quite generally chosen such that the reference voltage lies within the permissible tolerance even at the highest temperature specified for the application. As the temperature rises, so do the leakage currents, in particular of the second switching device in the open state. This leads to a voltage change at the charge storage device and to a deviation of the reference voltage from a desired value, caused by the leakage current of the open second switching device.

In a further particularly advantageous design of the reference voltage circuit according to the invention, therefore, a temperature monitoring circuit is integrated in the reference voltage circuit and, at a maximum temperature of the semiconductor substrate holding the reference voltage circuit, via further signal paths, blocks the control at least of the first and second switching devices by the pulse generator circuit or the voltage monitoring circuit. Above the maximum temperature, the first and second signal paths of the reference voltage circuit are permanently continuous.

The reference voltage circuit according to the invention makes it possible to generate a reference voltage signal with a power requirement reduced by a factor of up to approximately 100 compared with customary reference voltage circuits in typical applications. The method according to the invention makes it possible to operate such a reference voltage circuit.

In accordance with the method according to the invention, a reference voltage is generated by a reference voltage circuit, a reference voltage source occasionally being isolated from an auxiliary or supply potential and, in this case, a charge storage device being charged during an on-time period of uninterrupted voltage supply at least occasionally for the duration of a charging time period and the reference voltage signal being generated from the charge storage device at least during an off-time period of interrupted voltage supply.

According to a first embodiment of the method according to the invention, the charging of the charge storage device is preferably performed periodically. In an advantageous manner, in this case, firstly an at least required ratio of charging time period to the period duration is determined and the charging time period is fixed in accordance with the at least required quotient of charging time period and period duration. Subsequently, over a minimum charging time period, this also results in a minimum quotient of on-time period to the period duration (duty cycle) and, advantageously, in the lowest possible power consumption of the reference voltage source. In this case, the charging time period that is at least required results from the permissible tolerance of the reference voltage signal, the magnitude of the leakage current relating to the charge storage device and an often negligible magnitude of a load current at the reference voltage terminal.

According to a second preferred embodiment of the method according to the invention, the reference voltage signal is monitored by the comparison of the charging voltages of the charge storage device and a control storage device. In this case, the two storage devices have distinctly distinguishable capacitances.

During the on-time period, the two capacitances are charged to the same charging voltage, generally the reference voltage. During the off-time period, the two storage devices are decoupled from one another. In this case, the charging voltages of the two storage devices change on account of leakage currents. In this case, the level of the leakage currents is respectively predominantly determined by the switching devices, which isolate the respectively disconnected (floating) terminals of the two storage devices, and is independent of the capacitance to a first approximation. On account of their different capacitance, the two storage devices discharge at different speeds given approximately identical leakage currents. The deviation of the charging voltage of the charge storage device from a desired value of the reference voltage can be deduced from the difference between the two charging voltages. If the difference exceeds a fixed value, then a monitoring signal is generated. By means of the monitoring signal, the first and second switching devices and also the control switching device are driven and the reference voltage source is again connected to the auxiliary or supply potential and the charge and also the control storage device are again connected to the reference output of the reference voltage source.

Preferably, a beginning of a charging time period is delayed relative to a beginning of an on-time period by a delay TEL, firstly an optimum delay TEL being determined and fixed. On the one hand, the delay is chosen to be as short as possible in order to minimize the on-time period and thus the power consumption. On the other hand, the delay must be chosen to be at least long enough that the reference voltage signal is not corrupted any more than is permissible by the transient recovery of the reference voltage source.

The end of the on-time period is delayed relative to the end of the charging operation by a further delay time TLA to an extent such that the charging operation is reliably ended before the end of the on-time period, taking account of component tolerances.

Preferably, the on-time period of uninterrupted voltage supply is chosen to be essentially three times as great as the charging time period. Furthermore, the interval for charge storage is placed in the middle of the interval of the on-time period.

As already described, monolithically constructed bandgap references quite generally have a feedback path and a low-pass filter capacitance in the feedback path. An oscillation of the feedback system is prevented in a customary manner by means of the low-pass filter capacitance. When the bandgap reference is switched on, the low-pass filter capacitance is firstly at least partially charged before the reference voltage is present in stable fashion at the output of the bandgap reference. After the bandgap reference is switched off, the low-pass filter capacitance is at least partially discharged, so that it firstly has to be charged anew in the event of the bandgap reference being switched on again.

According to a further preferred embodiment of the method according to the invention, the low-pass filter capacitance is disconnected during the off-time period, so that both terminals of the low-pass filter capacitance are isolated. As a result, the charge on the low-pass filter capacitance is frozen during the off-time period. In the event of the bandgap reference being reconnected again, the low-pass filter capacitance is already charged. The time duration after which the reference voltage is present in stable fashion at the output of the bandgap reference is reduced. The charge storage device can be switched to the bandgap reference earlier by means of the second switching device without any loss of accuracy and the on-time period can therefore be shortened. This is advantageously accompanied by a further reduction of the power consumption.

The level of the leakage currents in a semiconductor device is highly dependent on the temperature of the semiconductor device. An increase in the temperature of the semiconductor device by about 6 K leads approximately to a doubling of the leakage current density. The operating currents are quite generally chosen such that the reference voltage lies within the permissible tolerance even at the highest temperature specified for the application. However, as the temperature rises, so do the leakage currents in particular of the second switching device in the open state. This leads to a voltage change at the charge storage device which is caused by the leakage current of the open second switching device.

In a further particularly advantageous embodiment of the method according to the invention, the temperature of a semiconductor device holding the reference voltage circuit is monitored. If the measured temperature exceeds a maximum temperature, then the first and second signal paths of the reference voltage circuit remain permanently continuous.

Preferably, the maximum temperature chosen is a temperature at which a leakage current that is then established necessitates a permanent charging operation of the charge storage device.

Other features which are considered as characteristic for the invention are set forth in the appended claims.

Although the invention is illustrated and described herein as embodied in a reference voltage circuit and method for the generation of a reference voltage, it is nevertheless not intended to be limited to the details shown, since various modifications and structural changes may be made therein without departing from the spirit of the invention and within the scope and range of equivalents of the claims.

The construction and method of operation of the invention, however, together with additional objects and advantages thereof will be best understood from the following description of specific embodiments when read in connection with the accompanying drawings.

DESCRIPTION OF THE PREFERRED EMBODIMENTS

Figure 1:
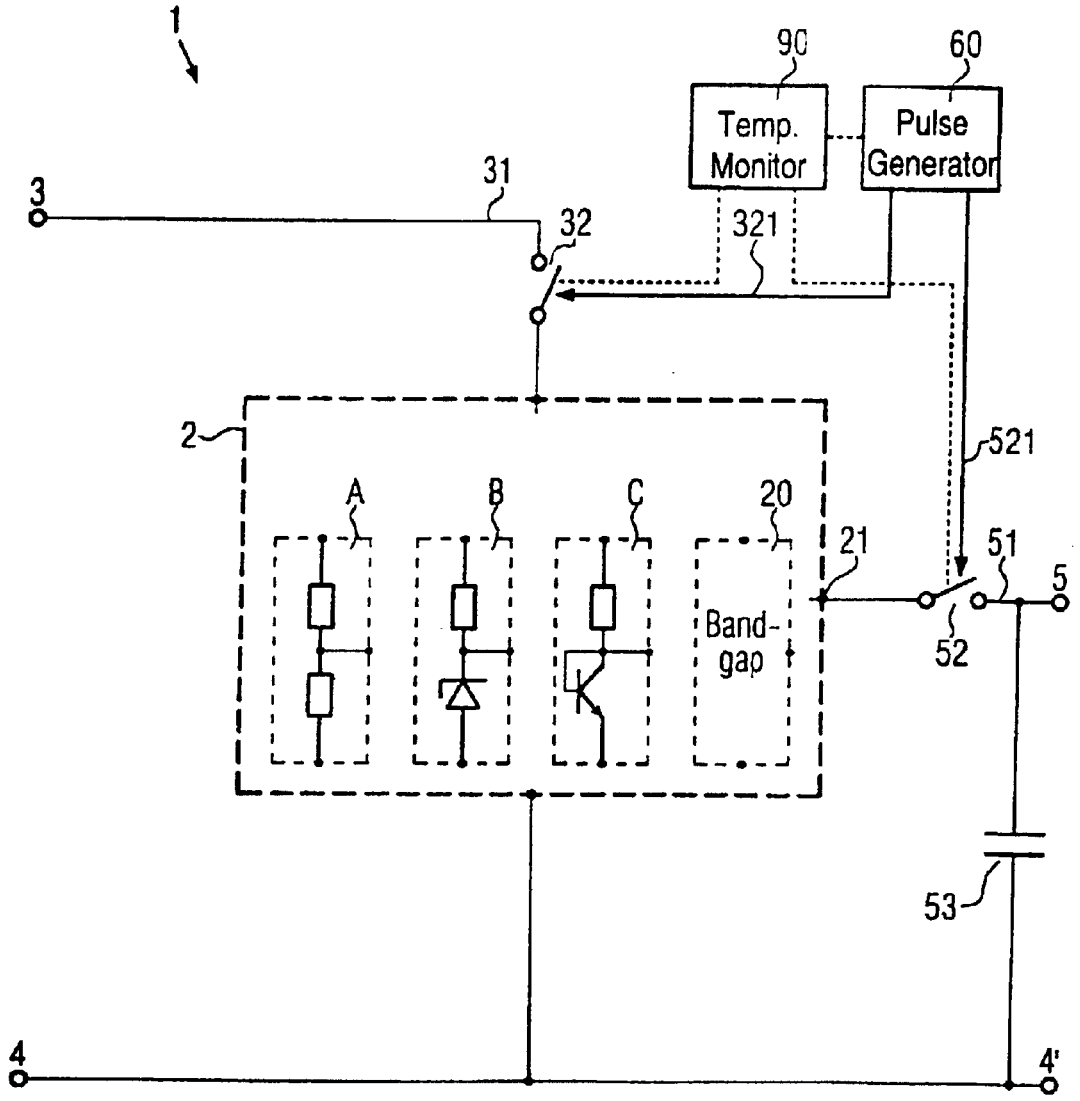
FIG. 1 is a simplified block diagram of a first exemplary embodiment of the reference voltage circuit according to the invention.

Referring now to the figures of the drawing in detail and first, particularly, to FIG. 1 thereof, there is shown a reference voltage circuit 1 with a reference voltage source 2. In this case, the reference voltage source 2 is alternatively embodied as passive voltage divider A, as Zener diode reference B, as base-emitter diode reference C, or as bandgap reference 20. The reference voltage source 2 is connected via a first signal path 31 to an input terminal 3, via which an auxiliary or supply potential is fed to the reference voltage source 2. Furthermore, a reference output 21 of the reference voltage source 2 is connected to the reference voltage terminal 5 via a second signal path 51. In this example, the reference voltage source 2 is furthermore connected to two reference terminals 4, 4' of the reference voltage circuit 1. In this case, an operating current fed by the auxiliary or supply potential is fed back via a first reference terminal 4. The reference voltage is present between the reference voltage terminal 5 and the second reference terminal 4'.

A first switching device 32 is connected in the first signal path 31. The switching device 32 can be controlled via a third signal path 321. A second switching device 52 is connected in the second signal path 51. The second switching device 52 can be controlled via a fourth signal path 521. A charge storage device 53 is arranged between the reference voltage terminal 5 and the second reference terminal 4'. Furthermore, the reference voltage circuit 1 has a pulse generator circuit 60, which is connected to the switching devices 32 and 52 via the third and fourth signal paths 321, 521.

Proceeding from the state during an off-time period during which both switching devices 32, 52 are open, the pulse generator circuit 60 generates an ENABLE signal, which closes the first switching device 32 via the third signal path 321. As a result, the reference voltage source 2 is connected to the auxiliary or supply potential connected between the input terminal 3 and the first reference potential 4. After a transient recovery time of the reference voltage source 2, a stable reference voltage is present at the reference output 21. At this point in time, the pulse generator circuit 60 generates a SAMPLE signal, which closes the switching device 52 via the fourth signal path 521. The charge storage device 53 is charged to the potential of the reference voltage via the reference output 21. The pulse generator circuit 60 thereupon ends the SAMPLE signal. The second switching device 52 is opened. The reference voltage is still dropped across the charge storage device 53. At the same time as the SAMPLE signal or afterward, the pulse generator circuit 60 ends the ENABLE signal and the first switching device 32 is opened. For an off-time period during which the first switching device 32 is open, the reference voltage source draws no operating current from the auxiliary or supply voltage.

The reference voltage circuit 1 furthermore has a temperature monitoring circuit 90, which is connected either to the pulse generator circuit 60 or to the switching devices 32, 52. The temperature monitoring circuit 90 detects the temperature of a semiconductor substrate wherein, for example, the second switching device 52 is arranged. If the temperature detected by the temperature monitoring circuit 90 exceeds a maximum temperature at which a voltage change brought about in particular by a leakage current at the open second switching device 52 corrupts the reference voltage at the reference voltage terminal in an impermissible manner, then the first and second switching devices 32, 52 are prevented from being opened.

Figure 2:
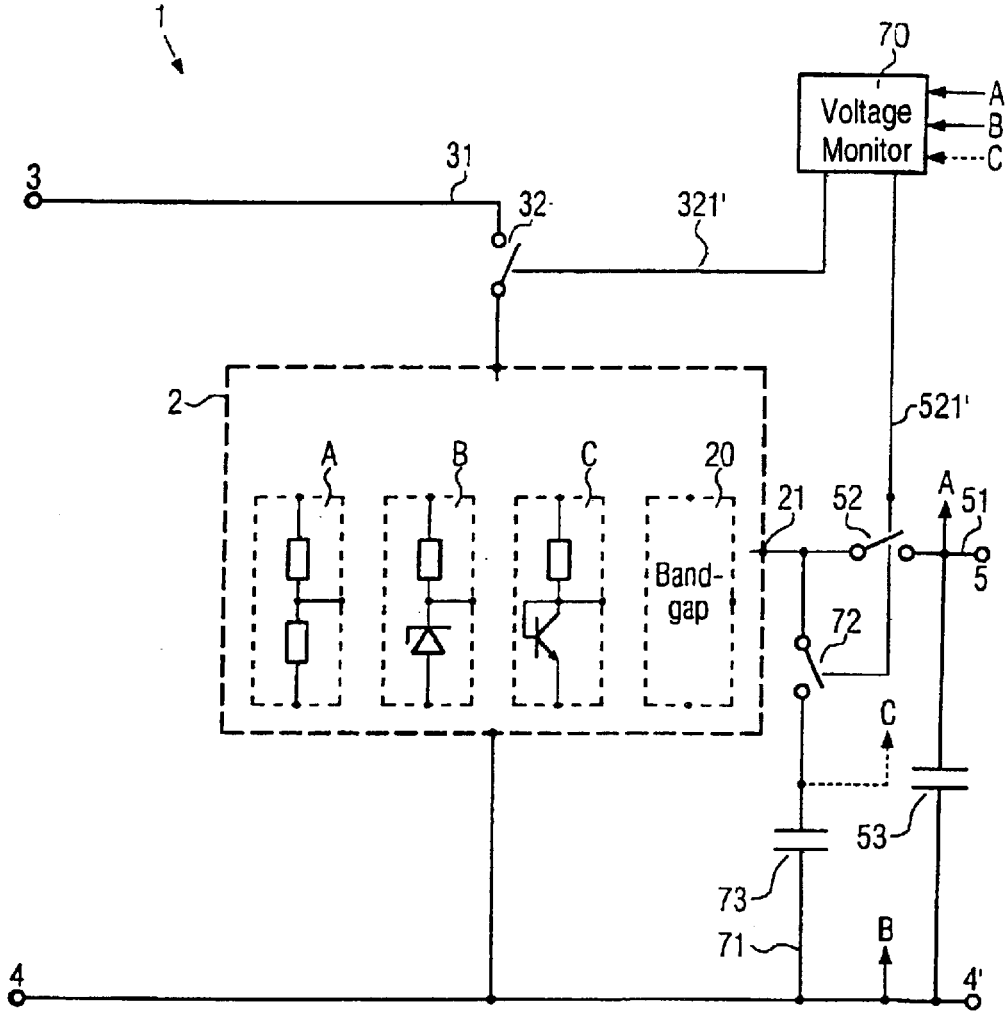
FIG. 2 is a simplified block diagram of a second exemplary embodiment of the reference voltage circuit according to the invention.

FIG. 2 differs from FIG. 1 by virtue of a voltage monitoring circuit 70 instead of the pulse generator circuit 60. The voltage monitoring circuit 70 does not generate the ENABLE and SAMPLE signals periodically, but rather in a manner dependent on an actual voltage change at the reference voltage terminal. In this case, a deviation of the reference voltage from a desired value is determined, in this example, by the comparison of the discharge curve of two storage devices 53, 73 having a different capacitance given capacitance-independent leakage currents.

For this purpose, the reference voltage circuit 1 has, in this example, a control path 71 between the reference output 21 and a reference terminal 4, 4'. A control switching device 72 and, in series therewith, a control storage device 73 are arranged in said control path 71.

The control switching device 72 is operated synchronously with the second switching device 52 by means of the SAMPLE signal. During a charging time period, the switching devices 52, 72 are closed and the control storage device 73 and the charge storage device 53 are charged to the same potential of the reference voltage. After the switching devices 52, 72 have opened, both the control storage device 73 and the charge storage device 53 start to discharge on account of leakage currents. The magnitude and the direction of the leakage currents are determined by the design of the assigned switching devices 52, 72 in the open state, that is to say are independent of the respective capacitance value to a first approximation. The storage devices 53, 73 discharge at different speeds. In the voltage monitoring circuit 70, the actual deviation of the reference voltage from a desired value is deduced from the voltage difference between the two charging voltages and the ENABLE and SAMPLE signals are controlled accordingly.

Figure 3:
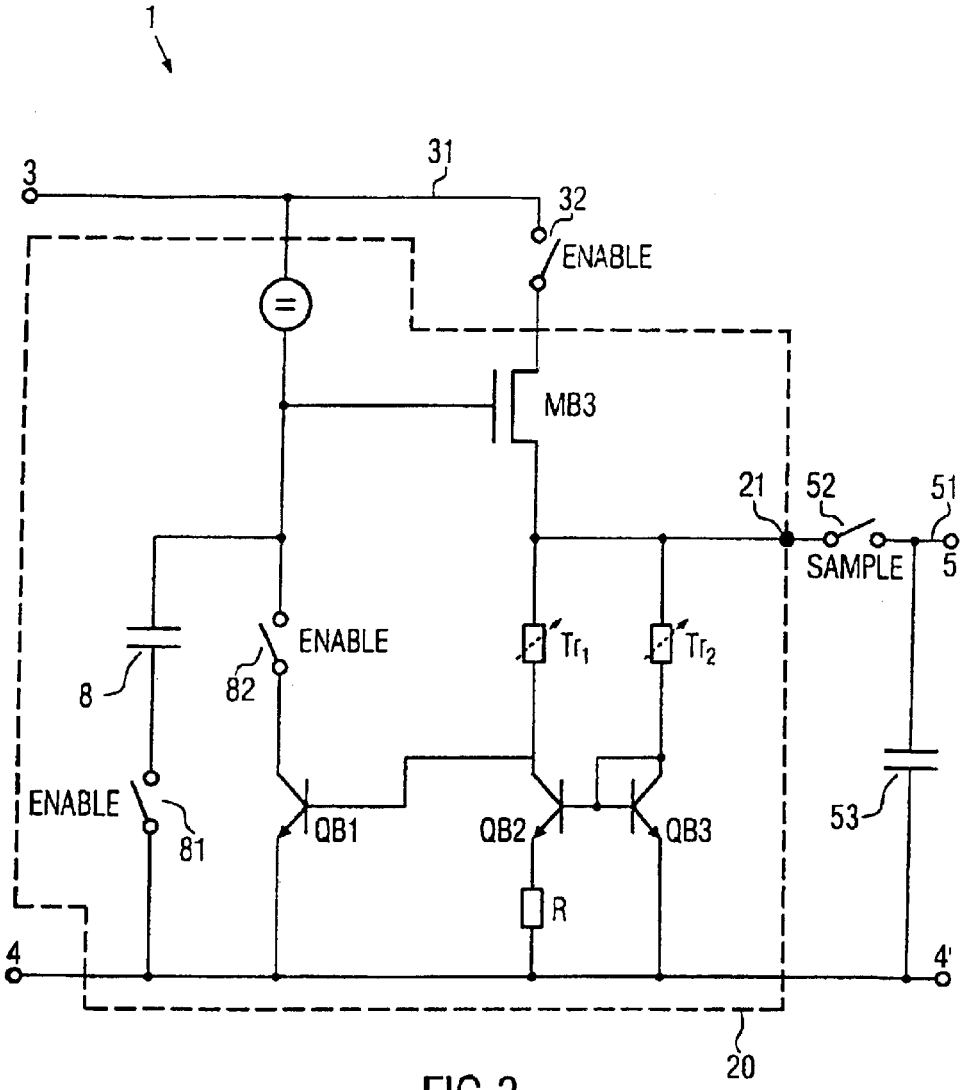
FIG. 3 is a simplified circuit diagram of a third exemplary embodiment of the reference voltage circuit according to the invention.

FIG. 3 illustrates a simplified example of a reference voltage circuit according to the invention with a bandgap reference 20 as reference voltage source. In this case, the collector currents of the transistors QB2 and QB3 are adjusted via a feedback path QB1, MB3, $Tr_1$, $Tr_2$. Arranged in the feedback path is a low-pass filter capacitance 8, which suppresses high frequencies and thus an inherent oscillation of the feedback system. The low-pass filter capacitance 8 furthermore has the effect that, after a closing of the first switching device 32, the reference voltage is present at the reference output 21 only in a delayed manner.

Therefore, in this exemplary embodiment of the reference voltage circuit according to the invention, further switching devices 81, 82 are provided in the leads to the low-pass filter capacitance 8, which switching devices are closed and opened essentially synchronously with the ENABLE signal and with the first switching device 32. As a result, a charge on the low-pass filter capacitance 8 is frozen. In the event of a subsequent ENABLE signal, the low-pass filter capacitance already has a precharge, as a result of which the reference voltage is present more rapidly in stable fashion at the reference output 21.

Figure 4:
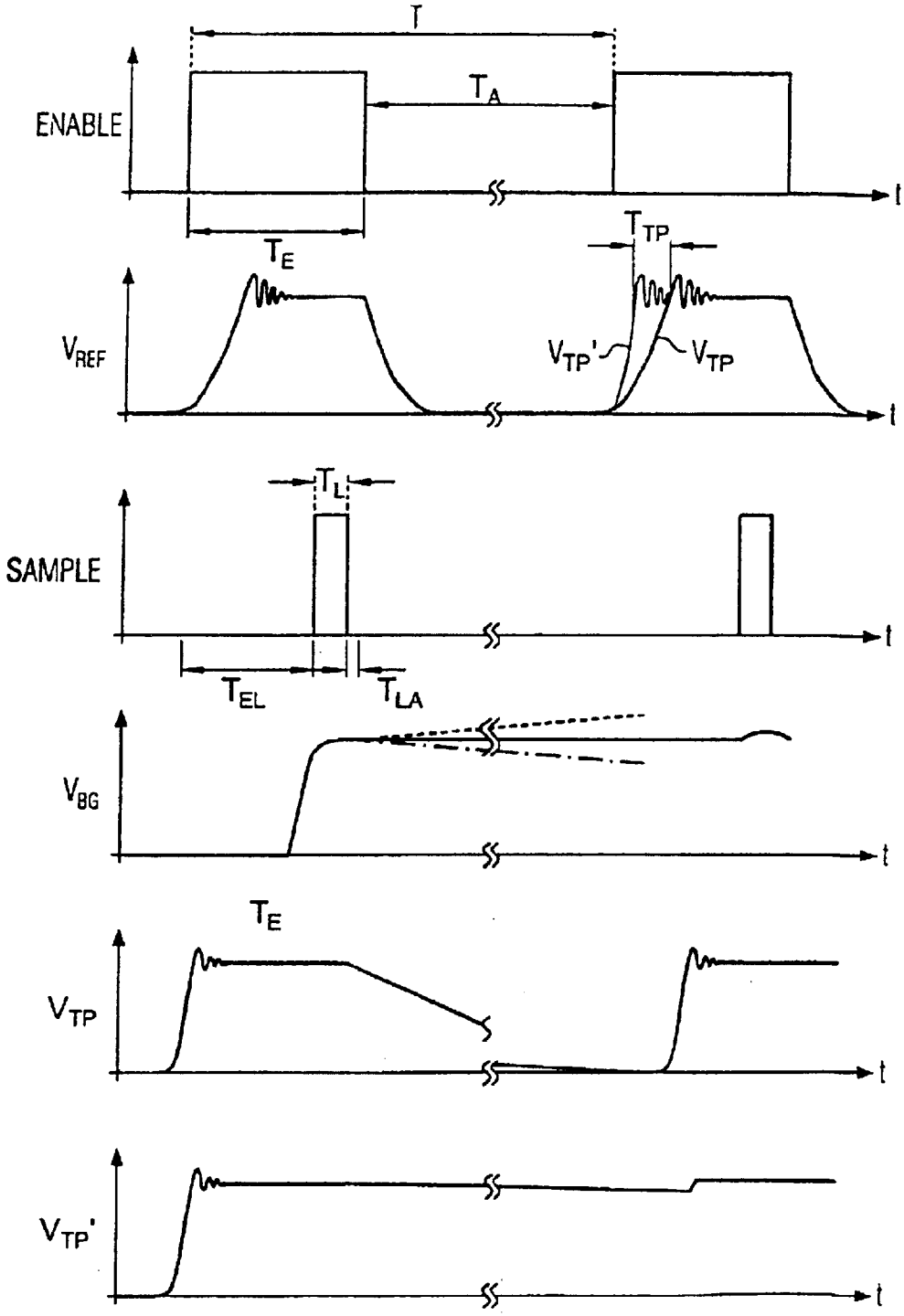
FIG. 4 is a timing diagram relating to the third exemplary embodiment of the reference voltage circuit according to the invention.

FIG. 4 illustrates the timing diagrams for the ENABLE signal, the voltage Vref at the reference output 21 of a bandgap reference 20, the SAMPLE signal, the reference voltage signal VBG at the reference voltage terminal 5, a voltage VTP across the low-pass filter capacitance 8 in an arrangement without further switching devices 81, 82 and a voltage VTP' across the low-pass filter capacitance 8 in an arrangement with further switching devices 81, 82.

On the basis of the ENABLE signal with pulses having a length of about 15 $\mu$s and a period of 1 ms, pulses that are delayed relative to the ENABLE pulses result at the reference output 21. The transient recovery process of the feedback system results in a transient recovery process of the pulse. After a time TEL, the amplitude of the oscillation has decayed to a value below 0.5% of the value of the reference voltage. Thereafter, a SAMPLE pulse is triggered and the charge storage device 53 is charged. The reference voltage signal VBG is dropped across the charge storage device 53. Once the reference voltage signal has reached a desired value of the reference voltage, firstly the SAMPLE pulse and simultaneously or thereafter the ENABLE pulse are reset. The voltage Vref at the reference output falls rapidly in accordance with a discharge curve. The voltage VBG at the reference voltage terminal rises or falls depending on the design of the second switching device as a P-MOSFET (dashed line) or N-MOSFET (dash-dotted line). A partial compensation of the leakage currents is obtained through a combination of N-MOSFET and P-MOSFET (solid line) as second switching device. On account of this compensation and a comparatively high capacitance of the charge storage device of about 15 pF, the voltage VBG changes comparatively slowly. After a period T, the charge of the charge storage device and thus the amplitude of the reference voltage signal are refreshed by a renewed ENABLE/SAMPLE cycle.

The signal profiles VTP and VTP' result at the low-pass filter capacitance 8, depending on whether or not further switching devices are provided. It can be seen that, as a result of an interim isolation of the terminals of the low-pass filter capacitance, the voltage VTP' reaches its final value more rapidly after renewed connection of the reference voltage source to an auxiliary or supply voltage. In the diagram for the reference voltage Vref, the second pulse has a delay time reduced by TTP.

Thus, the power consumption of a reference voltage circuit according to the invention can be reduced further at the expense of a restricted accuracy during a first switch-on phase of several milliseconds.

Figure 5:
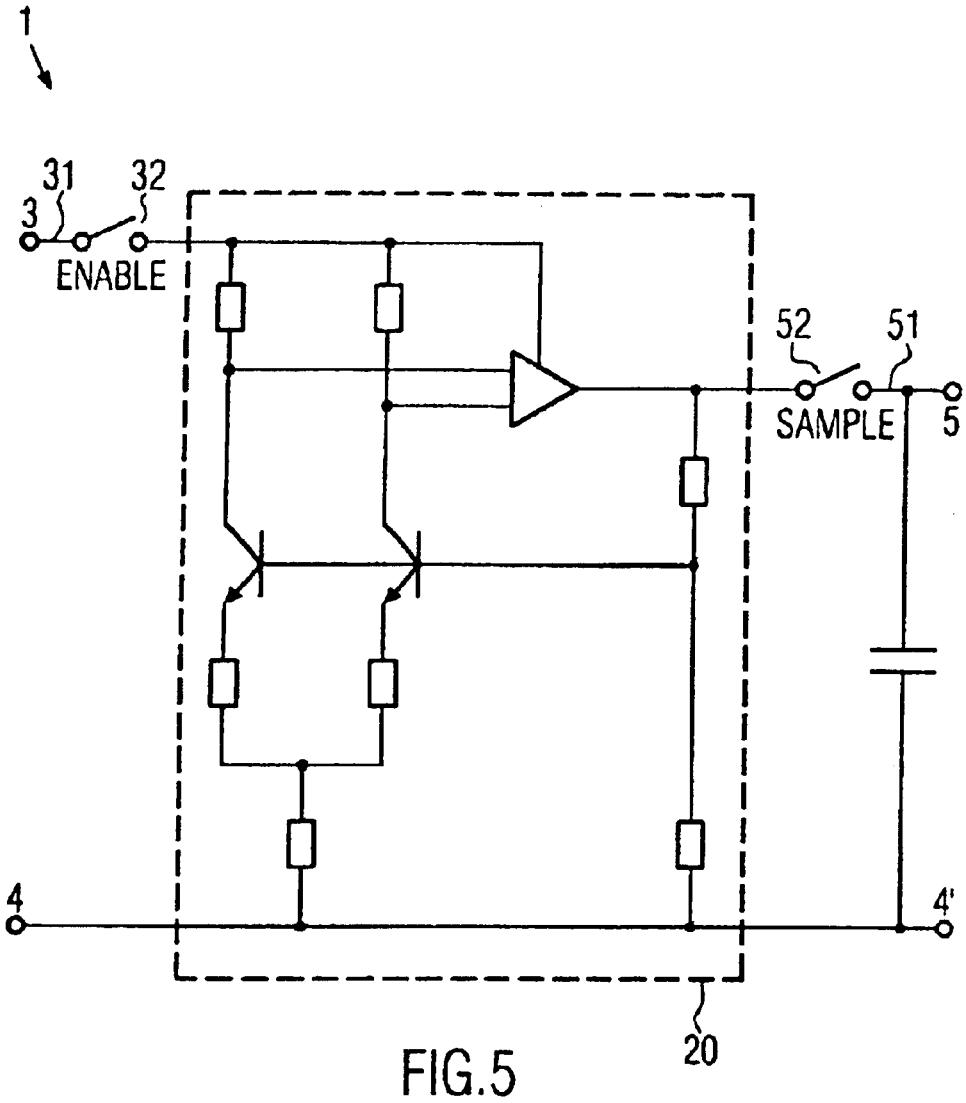
FIG. 5 is a simplified circuit diagram of a fourth exemplary embodiment of the reference voltage circuit according to the invention.

FIG. 5 illustrates a further exemplary embodiment of the reference voltage circuit according to the invention with a further type of bandgap reference.

Figure 6:
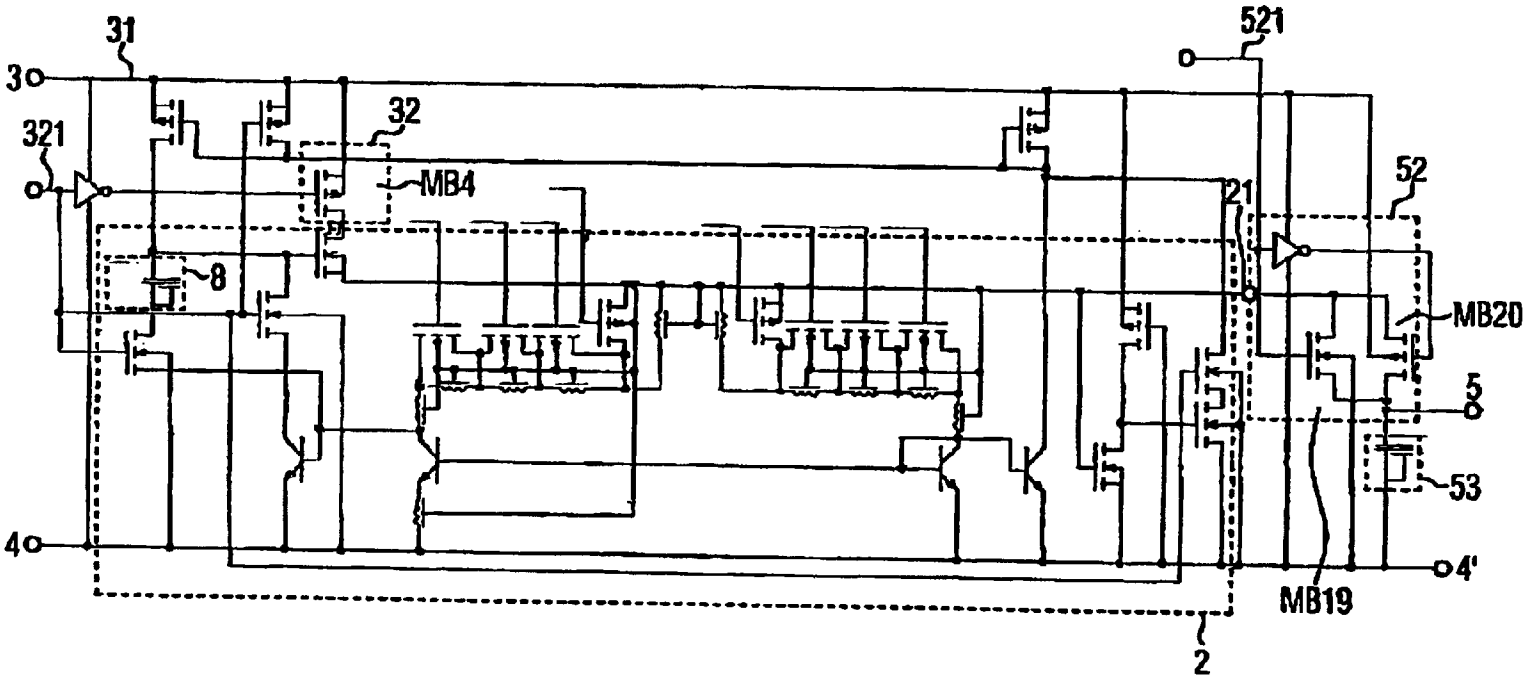
FIG. 6 is a more detailed circuit diagram of a reference voltage circuit based on the third exemplary embodiment.

FIG. 6 is a detailed circuit diagram of a reference voltage circuit according to the third exemplary embodiment. In this case, the second switching device 52 is realized by a parallel circuit comprising an N-MOSFET MB19 and a P-MOSFET MB20, as a result of which a partial compensation of the leakage currents of the two MOSFETs MB19, MB20 is obtained.

The operating current of the bandgap reference 20 is switched via the MOSFET MB4. In addition, the bandgap reference is also connected to the input terminal 3 via further signal paths which, however, have high impedance. The high-impedance signal paths make no appreciable contribution to the power consumption of the reference voltage circuit.

I claim:

1. A method of generating a reference voltage with a reference voltage circuit, the method which comprises:

charging a charge storage device at least occasionally during on-time periods of uninterrupted voltage supply of a reference voltage source;

interrupting the voltage supply of the reference voltage source for off-time periods;

providing the reference voltage from the charge storage device; and repeating the charging of the charge storage device step periodically or if a deviation of the reference voltage is greater than a permissible deviation from a desired value.

2. The method according to claim 1, which further comprises periodically controlling the charging of the charge storage device, and determining a ratio of a charging time period to a period duration from a permissible tolerance of the reference voltage, a magnitude of a leakage current of the reference voltage circuit, and a magnitude of a load current.

3. The method according to claim 1, which further comprises:

charging the charge storage device and a control storage device to the reference voltage, the charge storage device and the control storage device having mutually different capacitances;

disconnecting the control storage device substantially synchronously with the charge storage device from the reference voltage circuit and from the charge storage device;

monitoring the reference voltage by comparing the charging voltages of the charge storage device and the control storage device discharging at different time rates;

generating a monitoring signal in an event of an impermissible deviation of the reference voltage from the desired value; and controlling at least one of an interruption and an end of the interruption of the voltage supply and the charging of the charge storage device by way of the monitoring signal.

4. The method according to claim 1, which further comprises setting the on-time periods of uninterrupted voltage supply to be greater than the charging time period and delaying a beginning of a charging time period relative to a beginning of the on-time periods by a delay TEL, and choosing the delay TEL to ensure that an amplitude of the reference voltage deviates from the desired value of the reference voltage by not more than 1%.

5. The method according to claim 1, which further comprises delaying an end of the on-time periods relative to an end of the charging time period by a delay TLA, and choosing the delay TLA to ensure that a charging operation is reliably ended before the end of a respective one of the on-time periods, taking into account any production tolerances.

6. The method according to claim 1, wherein the on-time periods of uninterrupted voltage supply are each chosen to be essentially three times as long as the charging time period and the charging time period is placed in the middle of each of the on-time periods.

7. The method according to claim 1, which further comprises:

providing a bandgap reference with a feedback path and a low-pass filter capacitance in the feedback path as the reference voltage source;

disconnecting the low-pass filter capacitance during the off-time period;

causing the charge stored on the low-pass filter capacitance during the on-time periods to remain stored during the off-time periods; and switching the low-pass filter capacitance back into the feedback path at the beginning of the on-time period.

8. The method according to claim 1, wherein at least parts of the reference voltage source are formed in a semiconductor substrate and the method further comprises:

monitoring a temperature of the semiconductor substrate; and when a maximum temperature is exceeded, operating the reference voltage source without interruption and charging the charge storage device without interruption.

9. The method according to claim 8, which further comprises choosing the maximum temperature as a temperature at which at least one uninterrupted charging time period results from a permissible tolerance of the reference voltage, a magnitude of a leakage current of the reference voltage circuit, and a magnitude of a load current.

10. A reference voltage circuit, comprising:

a reference voltage source having an input terminal and a reference output and supplying a reference voltage at a said reference output;

an input terminal for feeding in an operating current, and a first signal path connecting said input terminal to said input terminal of said reference voltage source;

a reference voltage terminal and a second signal path connecting said reference voltage terminal to said reference output;

a first switching device connected in said first signal path, and a second switching device connected in said second signal path;

a charge storage device having a first terminal connected to said reference voltage terminal for a voltage supply thereof;

and wherein, in a first configuration of said first and second switching devices, said charge storage device is connected for temporarily charging with the operating current from said input terminal via said reference voltage source; and in a second configuration of said first and second switching devices, said reference voltage source and said charge storage device are isolated from said input terminal.

11. The reference voltage circuit according to claim 10, which further comprises a reference terminal, said charge storage device has a second terminal connected to said reference terminal.

12. The reference voltage circuit according to claim 10, wherein said reference voltage source is a monolithically integrated bandgap reference.

13. The reference voltage circuit according to claim 10, wherein said reference voltage source, said first and second switching devices, and said charge storage device are monolithically integrated.

14. The reference voltage circuit according to claim 12, which further comprises a pulse generator circuit for generating periodic control signals, a third signal path connecting said pulse generator circuit to said first switching device and a fourth signal path connecting said pulse generator circuit to said second switching device.

15. The reference voltage circuit according to claim 11, which further comprises a voltage monitoring circuit connected at least to said reference voltage terminal, said reference terminal, and controlling said first and second switching devices accordingly.

16. The reference voltage circuit according to claim 15, wherein said voltage monitoring circuit has a control path with a control switching device and a control storage device, said control switching device is connected in parallel with said second switching device at said reference voltage source and said control storage device is connected between said control switching device and a second terminal of said charge storage device, and wherein said control storage device has a capacitance significantly different from a capacitance of said charge storage device.

17. The reference voltage circuit according to claim 10, wherein said second switching device comprises a first MOSFET and a second MOSFET connected in parallel to said first MOSFET, said first MOSFET is an N-MOSFET, and said second MOSFET is a P-MOSFET.

18. The reference voltage circuit according to claim 14, which further comprises a low-pass filter capacitance provided in a feedback path of said bandgap reference for suppressing oscillations, and third and fourth switching devices, said third and fourth switching devices being controlled via fifth and six signal paths to said pulse generator circuit and disposed in leads of said low-pass filter capacitance.

19. The reference voltage circuit according to claim 14, which further comprises a temperature monitoring circuit connected via temperature monitoring signal paths to at least one of said first and second switching devices and said pulse generator circuit.

20. The reference voltage circuit according to claim 15:

wherein said reference voltage source is a monolithically integrated bandgap reference; and which further comprises a low-pass filter capacitance provided in a feedback path of said bandgap reference for suppressing oscillations, and third and fourth switching devices, said third and fourth switching devices being controlled via fifth and sixth signal paths to said voltage monitoring circuit and disposed in leads of said low-pass filter capacitance.

21. The reference voltage circuit according to claim 15, which further comprises a temperature monitoring circuit connected via temperature monitoring signal paths to at least one of said first and second switching devices and said voltage monitoring circuit.

22. A method of generating a reference voltage with a reference voltage circuit, the method which comprises the following steps:

providing a bandgap reference as a reference voltage source;

charging a charge storage device at least occasionally during on-time periods of uninterrupted voltage supply of the reference voltage source;

interrupting the voltage supply of the reference voltage source for off-time periods;

providing the reference voltage from the charge storage device; and repeating the charging of the charge storage device step periodically or if a deviation of the reference voltage is greater than a permissible deviation from a desired value.

23. A reference voltage circuit, comprising:

a bandgap reference forming a reference voltage source, said reference voltage source having an input terminal and a reference output, said reference voltage source supplying a reference voltage at said reference output;

an input terminal for feeding in an operating current, and a first signal path connecting said input terminal to said input terminal of said reference voltage source;

a reference voltage terminal and a second signal path connecting said reference voltage terminal to said reference output;

a first switching device connected in said first signal path, and a second switching device connected in said second signal path;

a charge storage device having a first terminal connected to said reference voltage terminal for a voltage supply thereof;

and wherein:

in a first configuration of said first and second switching devices, said charge storage device is connected for temporarily charging with the operating current from said input terminal via said reference voltage source; and in a second configuration of said first and second switching devices, said reference voltage source and said charge storage device are isolated from said input terminal.

* * * * *